US009579008B2

(12) United States Patent
Crocker

(10) Patent No.: US 9,579,008 B2
(45) Date of Patent: Feb. 28, 2017

(54) DYNAMIC BLADDER TANK ASSEMBLY FOR SURFACE CLEANING APPARATUS

(71) Applicant: Waterblasting, LLC, Stuart, FL (US)

(72) Inventor: James Crocker, Stuart, FL (US)

(73) Assignee: Waterblasting, LLC, Stuart, FL (US)

( * ) Notice: Subject to any disclaimer, the term of this patent is extended or adjusted under 35 U.S.C. 154(b) by 327 days.

(21) Appl. No.: 14/223,321

(22) Filed: Mar. 24, 2014

(65) Prior Publication Data

US 2014/0291330 A1 Oct. 2, 2014

Related U.S. Application Data

(60) Provisional application No. 61/805,802, filed on Mar. 27, 2013.

(51) Int. Cl.
*A47L 11/40* (2006.01)

(52) U.S. Cl.
CPC ..... *A47L 11/4083* (2013.01); *A47L 11/4016* (2013.01)

(58) Field of Classification Search
CPC .. A47L 11/34; A47L 11/4088; A47L 11/4083; A47L 11/4044; A47L 11/28; A47L 11/4016;A47L 7/0004; A47L 11/26; A47L 11/30; A47L 11/4027
See application file for complete search history.

(56) References Cited

U.S. PATENT DOCUMENTS 4,174,741 A * 11/1979 Parsons ..... B65D 88/62 141/2
5,331,713 A * 7/1994 Tipton ..... A47L 11/305 15/320
2012/0125615 A1* 5/2012 Ness ..... E21B 21/062 166/305.1

* cited by examiner

*Primary Examiner* — Robert Scruggs
(74) *Attorney, Agent, or Firm* — McHale & Slavin, P.A.

(57) ABSTRACT

The present invention relates generally to an environmentally sensitive mobile cleaning system; and more specifically relates to a holding tank that includes at least one internal bladder for high or ultra-high pressure mobile cleaning apparatus. The holding tank with internal bladder works in combination with a mobile pressure cleaning apparatus for cleaning surfaces while minimizing water usage and containing contaminants before they enter a storm water drain system.

19 Claims, 4 Drawing Sheets

DYNAMIC BLADDER TANK ASSEMBLY FOR SURFACE CLEANING APPARATUS

PRIORITY CLAIM

In accordance with 37 C.F.R. 1.76, a claim of priority is included in an Application Date Sheet filed concurrently herewith. Accordingly, the present invention claims priority to U.S. Provisional Application No. 61/805,802, entitled "Dynamic Bladder Tank Assembly for Surface Cleaning Apparatus", filed Mar. 27, 2013. The contents of the above referenced application are incorporated herein by reference in its entirety.

FIELD OF INVENTION

The present invention generally relates to surface cleaning systems, and more particularly to a fluid tank assembly that includes at least one dynamic bladder and is particularly suited for surface cleaning apparatus.

BACKGROUND INFORMATION

Surface cleaning apparatus, such as pressure washers, are useful for cleaning a variety of objects. Although there are many types of pressure washing systems, a typical system utilizes an engine that powers a pump. The inlet side of the pump is connected to a low pressure water source such as a tank or a municipal water supply, while the high pressure side of the pump is connected to a high pressure hose and wand for controlling the flow of high pressure water generated by the pump. The high pressure water is directed at a surface to dislodge dirt, paint and the like, and the water is generally allowed to drain into the storm sewer.

Ultra-high pressure washers, supplying more than 25,000 P.S.I., are also known. These systems include a large engine, typically diesel, which operates a large multi-cylinder pump to generate high volumes of water at ultra-high pressures. The ultra-high pressure water is directed through piping and/or hoses to various types of blast heads suitable for controlling the flow and direction of the ultra-high pressure water. One particular use for ultra-high pressure water devices is the removal of stripes or other markings from road surfaces. When polymers such as paint or melted thermoplastic are used for roadway marking, the surface of the pavement is penetrated from ⅛-⅜ inch by the material; whereby water blasting is the only known method of removing the stripe material from below the surface without removing a portion of the roadway surface. Ultra-high pressure water pressure washers are also utilized for removing paint from ships, cleaning industrial facilities, removing graffiti, removing rubber from aircraft runways and demolition.

One common device utilized with surface cleaning devices is a holding tank for water. The tanks are typically constructed of metal or plastic to include four sides, a top wall and a bottom wall for containing the water and preventing the water from splashing over the side during transport to a job site.

Several problems are associated with the standard water or fluid tanks. One such problem relates to the ability of the tank to contain only clean or only dirty (used) water at one time. Another problem requires the tank to be cleaned after containing used or dirty water before clean water can be stored in the tank for use with the high or ultra-high pressure water pump(s).

Therefore, there is a need in the art for a holding tank that includes at least one dynamic bladder within the confines of the tank walls. The combination of the tank and bladder should provide a dynamic separation between two stores of fluids. The tank with dynamic bladder should eliminate the need for cleaning the interior of the tank between changing from storage of a contaminated or dirty fluid and a clean fluid. The bladder in the tank should provide for full capacity of a first fluid, a second fluid or partial capacity of either fluid.

Thus, the present invention provides a fluid holding tank having at least one internal bladder, which overcomes the disadvantages of the prior art systems.

SUMMARY OF THE INVENTION

The present invention relates generally to an environmentally sensitive mobile cleaning system; and more specifically relates to a holding tank that includes at least one internal bladder for high or ultra-high pressure mobile cleaning apparatus. The holding tank with internal bladder works in combination with a mobile pressure cleaning apparatus for cleaning surfaces while minimizing water usage and containing contaminants before they enter a storm water drain system. In general, a cleaning system includes a holding/water tank sized to contain an established volume of fluid sufficient to circulate through the system, a pump to pressure the fluid to the spray bar or wand assembly, a vacuum system to return the contaminated fluid to the holding tank, albeit separated from the clean water within the holding tank by the bladder, and may include a filter means to remove the contaminants from the fluid so that cleaned fluid can be reintroduced to the spray bar assembly. The method comprises the steps of providing a tank having an internal bladder wherein clean fluid is stored within the bladder or outside of the bladder and within the tank, increasing the pressure of the fluid with a pump, jetting or blasting the surface with the pressurized fluid through the spray bar assembly, vacuuming the blasted fluid into the system, and removing a portion of the contaminants from the fluid, storing the fluid in the holding tank in the opposite place within the tank as the clean fluid, e.g. inside of the bladder or outside of the bladder and within the tank.

Accordingly, it is an objective of the present invention to provide an environmentally sensitive cleaning system.

It is a further objective of the present invention to provide a holding tank with a bladder for a surface cleaning apparatus.

It is yet a further objective of the present invention to provide a holding tank with at least one bladder wherein a first fluid may be stored inside of the bladder while a second fluid can be stored outside of the bladder within the same tank without intermixing.

It is another objective of the present invention to provide a holding tank with at least one internal bladder wherein the bladder acts as a dynamic divider for storing at least two fluids.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENTS

Figure 1:
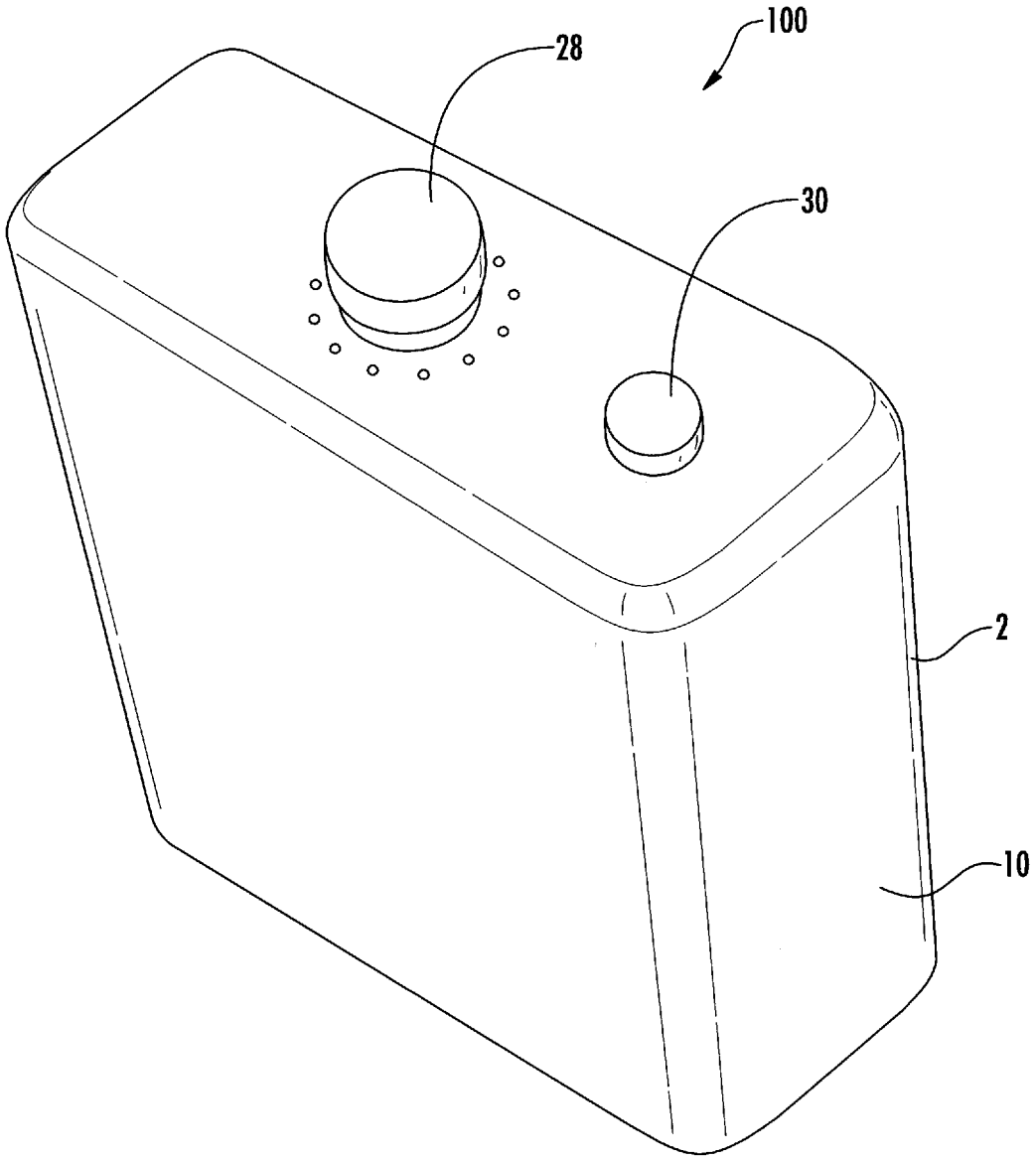
FIG. 1 is a top perspective view that illustrates one embodiment of the tank with at least one bladder for surface cleaning apparatus of the instant invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

Figure 2:
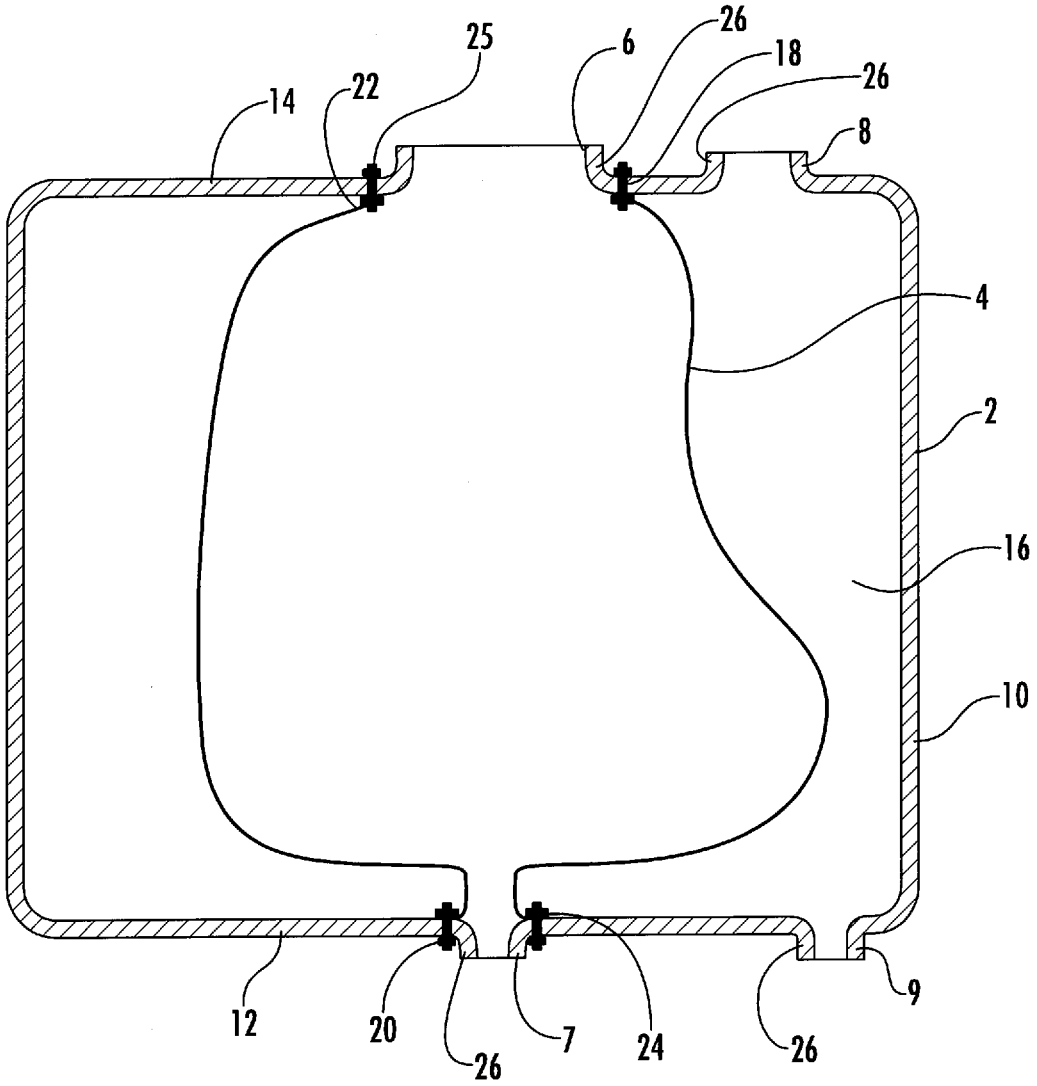
FIG. 2 is a sectional side view of the tank with bladder illustrated in FIG. 1.
Figure 3:
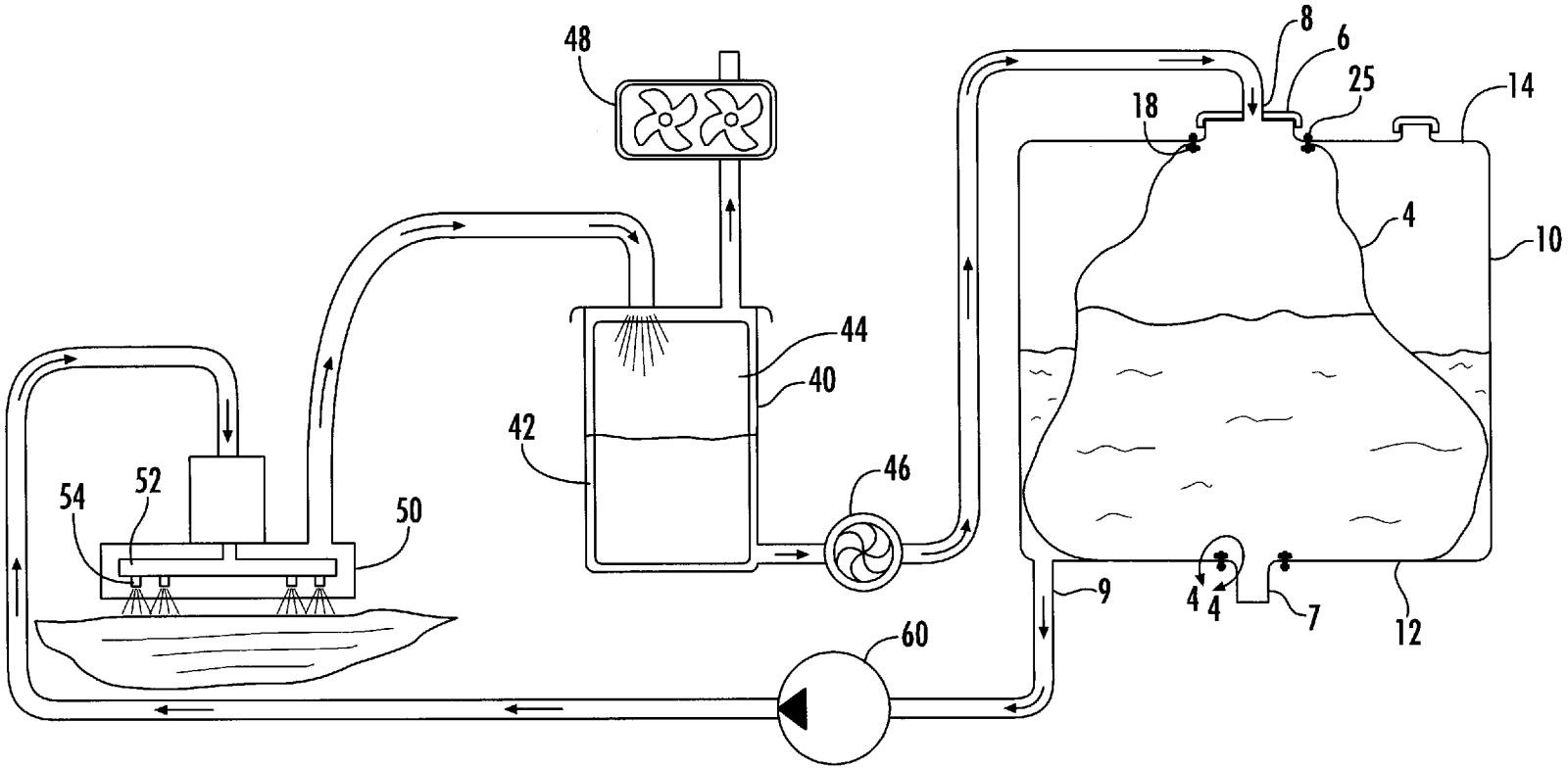
FIG. 3 is a schematic view of a water-blasting system utilizing the tank with bladder.
Figure 4:
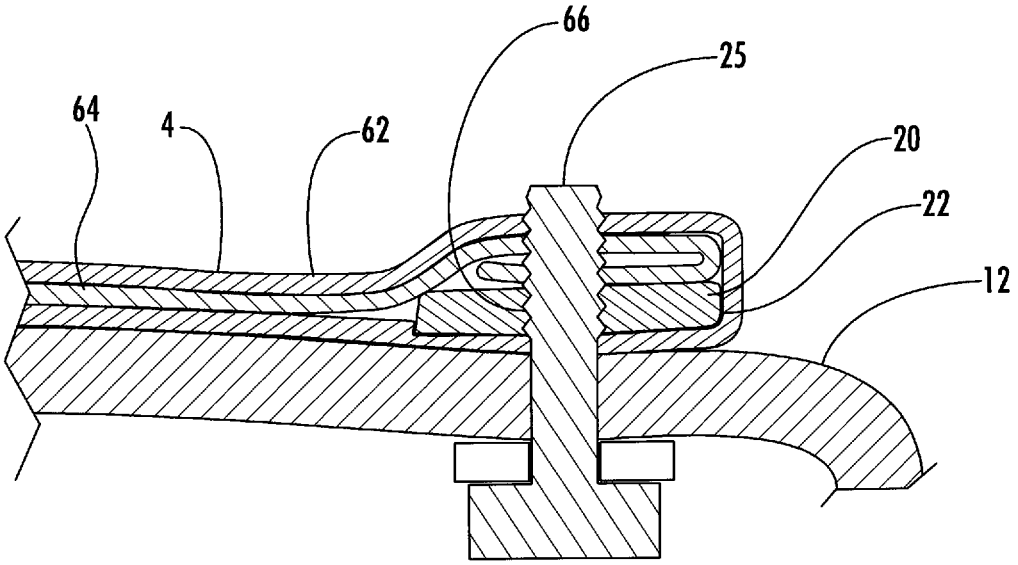
FIG. 4 is a partial section view taken along lines 4-4 of FIG. 3.

Referring generally to FIGS. 1-3, a tank with dynamic bladder 100 is illustrated. The tank with dynamic bladder generally includes a tank assembly 2, a bladder assembly 4, a bladder inlet 6, a bladder outlet 7, a tank inlet 8 and a tank outlet 9. In general, the tank with dynamic bladder 100 allows the storage and selected use of at least two fluids, preferably liquids, from the same tank 2. The volume of either fluid is infinitely variable to the entire volume of the tank. In addition, as one fluid is used, additional storage for a second fluid is provided. In general, the tank includes at least four side walls 10 and a bottom panel 12. In a most preferred embodiment, the tank assembly also includes a top panel 14. The top panel includes the bladder inlet 6 and tank inlet 8 through which one or more fluids may be introduced into the internal volume 16 of the tank assembly. The inlets are preferably integrally formed to the top panel; however, other means of securing an inlet to the top panel may be utilized without departing from the scope of the invention, such as welding, fastening, adhering, riveting and the like. The bottom panel of the tank assembly includes the bladder and tank outlets 7, 9 respectively. The tank outlets are preferably integrally formed to the bottom panel however; other means of securing the outlet to the bottom panel may be utilized without departing from the scope of the invention, such as welding, fastening, adhering, riveting, clamping and the like. It should also be noted that while the inlets and outlets are illustrated as positioned on the top and bottom panels, the skilled artisan will realize that side panels may alternatively be utilized without departing from the scope of the invention. The bladder 4 is preferably constructed from a flexible material to generally conform to the volume of fluid therein. In at least one embodiment, the bladder is constructed from a rubber 62 coated cloth 64 material to add strength to the bladder while still allowing the flexibility required to allow the bladder to conform to the shape of the tank. An inlet bolt ring 18 is provided around the bladder inlet for securing the bladder to the tank, and an outlet bolt ring 20 is provided for securing the bladder about the bladder outlet. The bolt ring preferably includes a metal ring 22, 24 embedded into the bladder and sealing the bladder to the appropriate tank surface. The metal rings 22, 24 include threaded apertures 66, or the like, which cooperate with fasteners 25 to secure the bladder to the inner surface of the tank in a sealed arrangement. Threads 26 or the like may be used to secure caps 28, 30 over the openings of the tank. In at least one embodiment, fresh water is stored within the inner volume 16 of the tank assembly. The water is allowed to flow or is pumped to an ultra-high pressure pump 60 where the water is pressurized to about 30,000 PSI for transfer to the blast head 50. The blast head 50 includes a spray bar 52 having a plurality of nozzles 54. A vacuum tank 40 is used to initially contain collected water and debris 42. A vacuum pump 48 is typically utilized to create a low pressure area within the vacuum tank to draw in the water and debris from the water jet blast head 50. Within the vacuum tank is a filter bag 44 that separates a portion of the solids entrained within the fluid from blasting. The water that flows through the filter bag is allowed to flow, or is pumped via pump 46 into the bladder, while the tank contains clean water, or visa-versa. This combination provides a unique advantage for surface cleaning apparatus: as the clean fluid is used, contaminated fluid is collected, requiring storage. The tank with dynamic bladder allows the used fluid to be stored in the same tank as the clean fluid, because one is being collected in substantially the same volume as the other is being used. It should also be noted that while one inlet and one outlet are illustrated for the bladder and the tank, any number of inlets and outlets may be utilized without departing from the scope of the invention.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A tank and dynamic bladder system comprising:

a tank assembly, said tank assembly including at least four side walls and a bottom panel connected together in a watertight manner, said tank assembly including a tank inlet for transfer of a first liquid into an internal volume of said tank and a tank outlet for transfer of said first liquid out of said tank volume, said tank assembly also including a bladder inlet for transfer of as second liquid into a bladder assembly, said bladder inlet including a bolt ring around said bladder inlet for securing said bladder assembly to said tank assembly, said bolt ring including a metal ring embedded into said bladder assembly, said metal ring including threaded apertures which cooperate with fasteners extending through a respective wall of said tank assembly to secure the bladder to said tank assembly in a sealed arrangement, and a bladder outlet for transferring said second liquid out of said bladder assembly;

said bladder assembly positioned within said tank assembly, said bladder assembly constructed from a flexible material to generally conform to the internal configuration of said tank assembly;

whereby the volume of said first liquid transferrable into said tank assembly and said second liquid transferrable into said bladder assembly are infinitely variable with respect to each other to fill the entire volume of said tank assembly.

2. The tank and dynamic bladder system of claim 1 wherein said tank assembly includes a top panel for enclosing the volume of said tank assembly.

3. The tank and dynamic bladder system of claim 2 wherein said tank assembly inlet and said bladder assembly inlet are integrally formed into said top panel.

4. The tank and dynamic bladder system of claim 2 wherein said bladder assembly includes a bolt ring around said bladder outlet for securing said bladder assembly to said tank assembly, said bolt ring including a metal ring embedded into said bladder assembly, said metal ring including threaded apertures which cooperate with fasteners extending through a respective wall of said tank assembly to secure the bladder to an inner surface of said tank assembly in a sealed arrangement.

5. The tank and dynamic bladder system of claim 2 including a vacuum tank for initially containing collected liquid and debris, said vacuum tank including a filter for removing a portion of said debris from said liquid, said liquid transferred to said bladder assembly.

6. The tank and dynamic bladder system of claim 5 wherein said filter is a filter bag.

7. The tank and dynamic bladder system of claim 5 wherein a vacuum pump is utilized to create a low pressure area within said vacuum tank for drawing said liquid and said debris into said vacuum tank.

8. The tank and dynamic bladder system of claim 7 wherein said liquid and said debris are drawn from a water jet blasting head.

9. The tank and dynamic bladder system of claim 8 wherein said tank assembly includes liquid which is supplied to ultra-high pressure pump for transfer to said water jet blasting head.

10. The tank and dynamic bladder system of claim 2 including a vacuum tank for initially containing collected liquid and debris, said vacuum tank including a filter for removing a portion of said debris from said liquid, said liquid transferred to said tank assembly.

11. The tank and dynamic bladder system of claim 10 wherein said filter is a filter bag.

12. The tank and dynamic bladder system of claim 10 wherein a vacuum pump is utilized to create a low pressure area within said vacuum tank for drawing said liquid and said debris into said vacuum tank.

13. The tank and dynamic bladder system of claim 12 wherein said liquid and said debris are drawn from a water jet blasting head.

14. The tank and dynamic bladder system of claim 13 wherein said bladder assembly includes liquid which is supplied to ultra-high pressure pump for transfer to said water jet blasting head.

15. The tank and dynamic bladder system of claim 1 wherein said tank assembly outlet and said bladder assembly outlet are integrally formed into said bottom panel.

16. The tank and dynamic bladder system of claim 1 wherein said tank assembly outlet and said bladder assembly outlet are integrally formed into at least one of said four side walls.

17. The tank and dynamic bladder system of claim 1 wherein said bladder assembly is constructed from a polymer coated cloth material to add strength to said bladder assembly while still allowing the flexibility required to allow said bladder assembly to substantially conform to the shape of said tank assembly.

18. The tank and dynamic bladder system of claim 17 wherein said polymer is rubber.

19. A tank and dynamic bladder system comprising:

a tank assembly, said tank assembly including at least four side walls and a bottom panel connected together in a watertight manner, said tank assembly including a tank inlet for transfer of a first liquid into an internal volume of said tank and a tank outlet for transfer of said first liquid out of said tank volume, said tank assembly also including a bladder inlet for transfer of as second liquid into a bladder assembly and a bladder outlet for transferring said second liquid out of said bladder assembly, said bladder outlet including a bolt ring around said bladder outlet for securing said bladder assembly to said tank assembly, said bolt ring including a metal ring embedded into said bladder assembly, said metal ring including threaded apertures which cooperate with fasteners extending through a respective wall of said tank assembly to secure the bladder to said tank assembly in a sealed arrangement;

said bladder assembly positioned within said tank assembly, said bladder assembly constructed from a flexible material to generally conform to the internal configuration of said tank assembly;

whereby the volume of said first liquid transferrable into said tank assembly and said second liquid transferrable into said bladder assembly are infinitely variable with respect to each other to fill the entire volume of said tank assembly.

* * * * *